US007350494B2

(12) United States Patent
Schricker et al.

(10) Patent No.: US 7,350,494 B2
(45) Date of Patent: Apr. 1, 2008

(54) GLOW PLUG WITH INTEGRATED PRESSURE SENSOR

(75) Inventors: Alexander Schricker, Graz (AT); Alexander Friedl, Graz (AT); Michael Hirschler, Graz (AT); Dietmar Kröger, Graz (AT)

(73) Assignee: Piezocryst Advanced Sensorics GmbH, Graz (AT)

( * ) Notice: Subject to any disclaimer, the term of this patent is extended or adjusted under 35 U.S.C. 154(b) by 0 days.

(21) Appl. No.: 11/785,173

(22) Filed: Apr. 16, 2007

(65) Prior Publication Data

US 2007/0245805 A1 Oct. 25, 2007

(30) Foreign Application Priority Data

Apr. 20, 2006 (AT) ..... A 671/2006

(51) Int. Cl.
*F02P 19/00* (2006.01)

(52) U.S. Cl. ..... 123/145 A; 219/270

(58) Field of Classification Search ..... 123/145 A; 219/270

See application file for complete search history.

(56) References Cited

U.S. PATENT DOCUMENTS 7,214,908 B2 * 5/2007 Wlodarczyk ..... 219/270
2005/0098136 A1 * 5/2005 Zhu et al. ..... 123/145 A
2007/0209624 A1 * 9/2007 Ludwig et al. ..... 123/145 A

FOREIGN PATENT DOCUMENTS

| | | |
|---|---|---|
| AT | 402116 | 2/1997 |
| DE | 10346330 | 5/2005 |
| DE | 102004047143 | 4/2006 |
| EP | 1074828 | 2/2001 |
| EP | 1096141 | 5/2001 |
| WO | 2006089446 | 8/2006 |

* cited by examiner

*Primary Examiner*—Erick Solis
(74) *Attorney, Agent, or Firm*—Dykema Gossett PLLC

(57) ABSTRACT

The invention relates to a glow plug with integrated pressure sensor for measuring pressure in the combustion chamber of an internal combustion engine, where the shell of the glow plug has a section of reduced diameter on the side next to the combustion chamber and following a sealing cone, which section houses a glow coil and ends in a tip extending into the combustion chamber, and where the pressure sensor is positioned without cooling in the section of the glow plug next to combustion chamber. According to the invention the pressure sensor is subjected to pressure in radial direction, the glow coil of the glow plug or the electrical leads of the glow coil being guided towards the tip of the glow plug either by bypassing the pressure sensor or going through the pressure sensor.

13 Claims, 3 Drawing Sheets

GLOW PLUG WITH INTEGRATED PRESSURE SENSOR

BACKGROUND OF THE INVENTION

The invention relates to a glow plug with an integrated pressure sensor for measuring pressure in the combustion chamber of an internal combustion engine, where the shell of the glow plug has a section of reduced diameter on the side of the combustion chamber, which houses a glow coil and ends in a tip protruding into the combustion chamber, the pressure sensor being positioned without cooling in the section of the glow plug adjacent to combustion chamber.

The pressure prevailing in the combustion chamber is an essential variable in studying the combustion process of an internal combustion engine. To implement pressure controlled valve timing efforts are made in order to enable pressure measurement in the combustion chamber. As it is economically not feasible to provide a separate bore or opening into the combustion chamber for the purpose of pressure measurement and as the geometry of the combustion chamber should not be altered, the existing bores for a spark plug or a glow plug should be used for pressure measurement.

DESCRIPTION OF PRIOR ART

An arrangement in which the spark plug incorporates the pressure measuring function has for instance been disclosed in AT 402.116 B. In the measuring device presented therein a ring-shaped pressure measuring element is provided, which supports the insulating body of the spark plug against the spark plug shell. The pressure acting on the spark plug is thus transmitted to the ring-shaped measuring element, an essential disadvantage of this kind of pressure measurement being that a relatively large mass, i.e., the mass of the insulating body of the spark plug, has a negative influence on the pressure measurement.

Similar disadvantages occur when pressure sensors are adapted for glow plug bores, where ring-shaped pressure sensors are placed between the measuring probe and the seat of the glow plug. Solutions using a movably guided glow pencil, which presses against a measuring element located at the end of the pencil distant from the combustion chamber, show long-term effects due to deposits forming at the contact surfaces between glow pencil and glow plug shell. From DE 103 46 330 A1, for instance, there is known a pressure measuring glow plug for a diesel engine, which has a heating rod in the plug body and a pressure sensor generating a signal corresponding to the pressure in the combustion chamber of the cylinder, which pressure is transmitted via the body of the plug or via the heating rod. The pressure sensor is positioned in the plug body between body and heating rod, or rather the inner end of the heating rod, in such a way that it is subjected to the transmitted pressure.

A similar pressure measuring device integrated in a glow plug is known from EP 1 096 141 A2, where a pressure sensor is located between the shell and the glow pencil of the glow plug guided in the shell, and where the sensor lies in the cooler region of the glow plug distant from the combustion chamber. Both arrangements have the disadvantage that relatively large masses are moved in pressure measurement, which has negative effects on the pressure measurement signal.

From DE 10 2004 047 143 A1 and WO 2006/089446 A1 it is known in the context of a glow plug with integrated pressure sensor to position a piezoelectric sensor without cooling in the region of the glow plug facing the combustion chamber, with the electrical leads of the glow coil being passed through the pressure sensor to the tip of the glow plug. Pressure is applied axially to the piezoelectric pressure sensor, giving rise to the disadvantages cited above in the case of EP 1 096 141 A2.

It is therefore of advantage if only small masses have to be moved in the course of pressure measurement and if the pressure measuring element or the pressure sensor is brought as near as possible to the combustion chamber. This may for instance be achieved with a pressure measuring device integrated in a spark plug as disclosed by EP 1 074 828 A2. The spark plug has a through-going longitudinal eccentric bore in the spark plug shell, which is slightly inclined against the axis of the spark plug and contains a pressure measuring device whose pressure measuring element is located near the combustion chamber. The shell diameter of this arrangement is however relatively large, thus precluding its use in a glow pencil bore.

Pressure sensors may also be inserted into the glow plug bores of internal combustion engines using a suitable adaptor, as is demonstrated by a state-of-the-art example shown in FIG. 1. The pressure sensor 2 for measuring the pressure in the combustion chamber 3 of an internal combustion engine is inserted into a glow plug bore 4 by means of a glow plug adaptor 11. The non-cooled pressure sensor 2 is located in the front part of the housing 6 and is subjected to the pressure prevailing in the combustion chamber via a sensor membrane 12. The adaptor 11 has a tip 10 protruding into the combustion chamber 3, which has the outer contour of a glow pencil or a glow plug. In tip 10 there are provided gas exchange passages 13 connecting the sensor membrane 12 with the pressure present in the combustion chamber 3 of the internal combustion engine. The glow plug adaptor 11 into which the pressure sensor 2 is built sealing off the front, has a sealing cone 7, which sits tightly in the seat 5 of the glow plug bore 4.

In this known implementation the force on the measuring element 2 is applied parallel to the axis 1' on the one hand via the sensor membrane 12 and on the other hand via the adaptor housing 6 on the opposite side. It is of disadvantage that the glow plug adaptor cannot emulate the function of a glow plug since its tip cannot be heated, thus creating a measuring situation which differs from normal operating conditions.

Measurement probes in which sensor membrane and pressure measuring element are distant from the combustion chamber (for instance located in the area of the glow plug seat) have long gas exchange passages giving rise to pipe vibrations, which are undesirable in a measuring situation.

SUMMARY OF THE INVENTION

It is the object of the present invention to improve a glow plug with integrated pressure sensor for measuring pressure in the combustion chamber of an internal combustion engine in such a way that function and exterior shape of the glow plug remain unchanged while positioning the pressure sensor in the vicinity of the combustion chamber and keeping the gas passages short and the moved masses small.

Acccording to the invention this object is achieved by providing that the pressure sensor is placed without cooling in the section of the glow plug next to the combustion chamber, and that pressure is applied to the pressure sensor in radial direction, and that the glow coil of the glow plug or its electrical leads are passed to the tip of the glow plug either beside or through the pressure sensor.

In a first embodiment of the invention a piezoelectric pressure sensor is placed between two opposing membranes in a radial through-bore or orifice of the part of the glow plug next to the combustion chamber, with the glow coil or the electrical leads of the glow coil being passed to the tip of the glow plug beside the piezoelectric pressure sensor.

The piezoelectric pressure sensor is at both ends sealed by a membrane. The two membranes define the main direction of pressure applied to the measuring elements of the pressure sensor, while the other parts of the sensor housing serve to hold the measuring elements and to conduct the charge signal and to avoid the application of pressure on all sides of the measuring elements.

According to a variant of the invention the piezoelectric pressure sensor is provided with a small measuring tube closed by a membrane at both ends, which is inserted into the radial bore and whose longitudinal axis forms a right angle with the longitudinal axis of the glow plug, at least one piezoelectric measuring element being located between the two membranes. In the area of the axis of the glow plug the small measuring tube has an opening through which the leads carrying the measurement signal will pass. A glow plug shell adapted in this way offers the following advantages:

- measuring membrane near the combustion chamber
- very little mass in front of the measuring element
- built-in measuring probe without adaptor
- good signal quality and high information content of the pressure signal
- enough free space for the glow coil to bypass the sensor
- unimpaired glow plug function
- due to short gas exchange paths pipe vibrations are avoided The pressure sensor of the invention preferably has a cylindrical shape and is provided with two opposing membranes, which—when subjected to pressure—will in turn transmit force to the piezoelectric measuring element or elements. The membranes are not necessarily of metal, but could also be made of glass, sapphire glass or ceramics, and are preferably directly attached to the measuring element. The cylindrical tube encloses the measuring element in such a way that pressure cannot act via the tube walls on the side faces of the measuring element but is applied primarily along the direction of the tube axis via the membranes at the end faces of the measuring element. The measuring element is preferably aligned such that pressure-induced polarization may be picked up from the side faces. These side faces are contacted by electrodes, with either both electrodes contacted by signal leads or one of the electrodes being in contact with the glow plug shell.

For pressure measurement near the combustion chamber measuring elements made of highly temperature-stable material, such as $GaPO_4$, or materials based on thin-film technology, are used in the invention.

According to a second variant of the invention a preferably cylindrical membrane is provided in the section of the glow plug next to the combustion chamber, on whose inner side a high-temperature stable strain gauge (DMS-sensor) is applied, the glow coil or the electrical leads of the glow coil being passed towards the glow plug tip through the cylindrical space bounded by the strain gauge strip. The strain gauge strip is for instance made from an F—Cr—Al alloy. When the cylindrical membrane is subjected to pressure the stress-strain state of the strain gauge changes and the resulting measuring signal is proportional to the pressure applied.

In a third variant of the invention a preferably cylindrical membrane is provided in the section of the glow plug next to the combustion chamber, which in combination with an electrically conductive counter-surface disposed at a small distance forms a capacitive pressure sensor, the glow coil or the electrical leads of the glow coil being passed towards the glow plug tip through the cylindrical interior space bounded by the counter-surface. When the cylindrical membrane is subjected to pressure the distance to the counter-surface changes. The resulting change in capacity is a measure of the pressure applied.

BRIEF DESCRIPTION OF THE DRAWINGS

The invention will be further described below, with reference to the enclosed drawings, wherein.

DETAILED DESCRIPTION OF THE DRAWINGS

Figure 1:
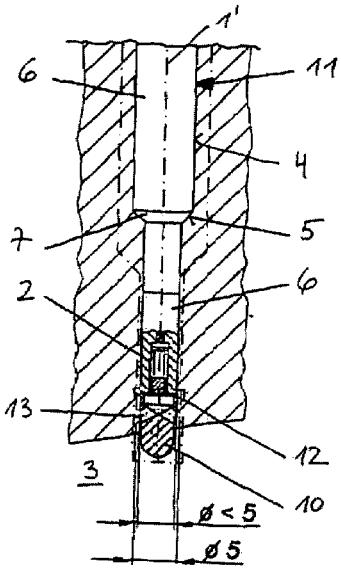
FIG. 1 shows a state-of-the-art pressure measuring probe in a sectional view.

The state-of-the-art pressure measuring probe shown in FIG. 1 has already been discussed in the introduction.

Figure 2:
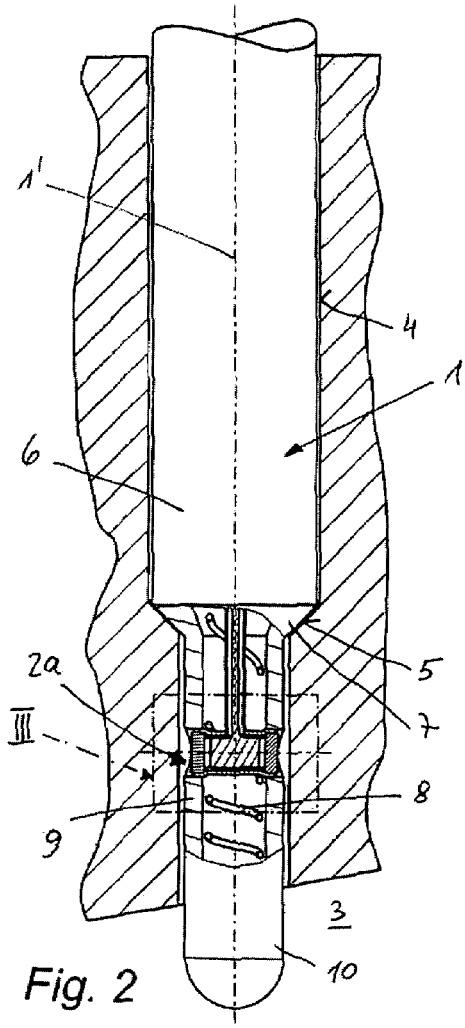
FIG. 2 a glow plug with integrated pressure sensor according to the invention in a sectional view.
Figure 3:
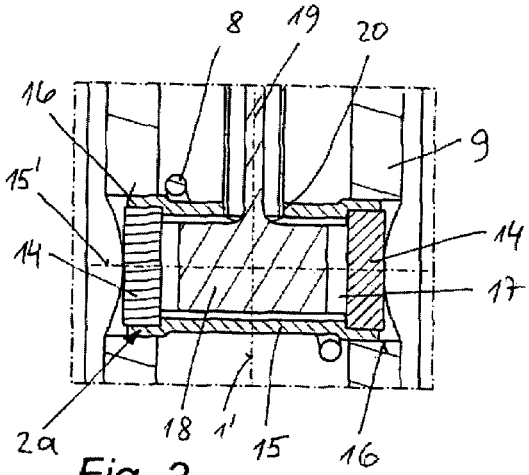
FIG. 3 an enlarged detail III from FIG. 2.
Figure 4:
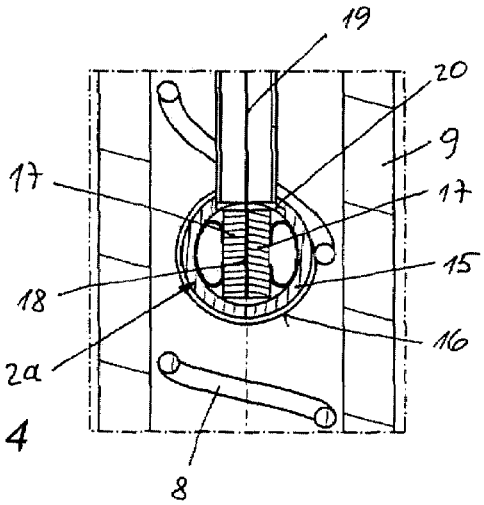
FIG. 4 detail III rotated by 90°.

The glow plug 1 shown in FIGS. 2 to 4 has an integrated pressure sensor 2 while remaining fully functional as a glow plug. The pressure sensor 2 is used for measuring the pressure in the combustion chamber 3 of an internal combustion engine (not further shown), the glow plug 1 being inserted into a glow plug bore 4, which is provided with a conical seat 5. Departing from a sealing cone 7, which fits the conical seat 5, the shell 6 of the glow plug 1 has a slender section 9, with diameter <5 mm, extending towards the combustion chamber. The section 9 adjacent to the combustion chamber terminates in the rounded tip 10 of the glow plug 1, which protrudes slightly into the combustion chamber 3. In the first variant according to FIG. 2 to 4 a piezoelectric pressure sensor 2*a* is used, which is located without cooling in the section 9 of the glow plug 1 adjacent to the combustion chamber. In contrast to the state of the art, pressure on the pressure sensor 2*a* is applied in radial direction, i.e. normal to the axis 1' of the glow plug 1, and in all variants of the invention the glow coil 8 of the glow plug 1 passes towards the tip 10 of the glow plug 1 either along the side the pressure sensor 2*a* or through the pressure sensor 2*b*, 2*c* (see FIGS. 5 to 8).

The piezoelectric pressure sensor 2*a* is placed in a radial through-bore 16 of the section 9 of the glow plug 1 adjacent to the combustion chamber between two opposing membranes 14. As can be seen from FIGS. 3 and 4 the glow coil 8 passes by the piezoelectric pressure sensor 2*a* as it goes towards the tip 10 of the glow plug. This results in a very compact assembly having diameter <5 mm in the area of the pressure sensor.

The piezoelectric pressure sensor 2*a* essentially consists of the small measuring tube 15 closed at both ends by membranes 14, which is inserted into the radial bore 16 and whose longitudinal axis 15' is at a right angle to the longitudinal axis 1' of the glow plug. Two or more strip-shaped measuring elements 17 may be placed between the membranes 14, the smaller sides of the measuring elements 17 contacting the membranes 14 and the transversal piezoeffect being utilized. Variants of this arrangement are possible, in which a plurality of disk-shaped measuring elements forming an element stack are placed in the small measuring tube 15.

In the embodiment shown a plane pick-up electrode 18 is provided between a pair of piezoelectric measuring elements 17, with at least one signal lead 19 exiting through an opening 20 in the wall of the small measuring tube 15. Via spring elements 27 the other sides of the measuring elements 17 are in electrically conductive contact with the small measuring tube 15 and thus with the glow plug shell 6. It would also be possible to provide signal leads for both electrodes of the measuring elements 17.

The signal leads are preferably located in the interior of the glow plug 1 protected by a thin guiding tube 28.

Figure 6:
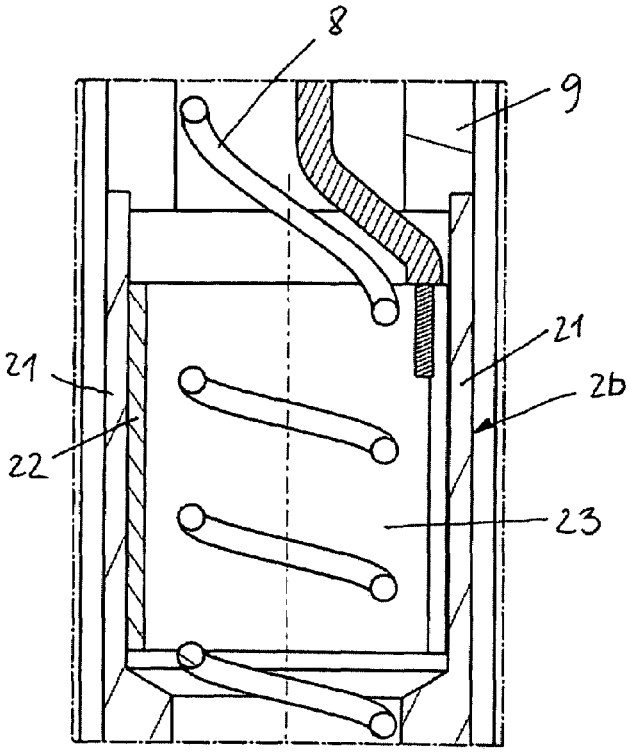
FIG. 6 a detail VI from FIG. 5.
Figure 5:
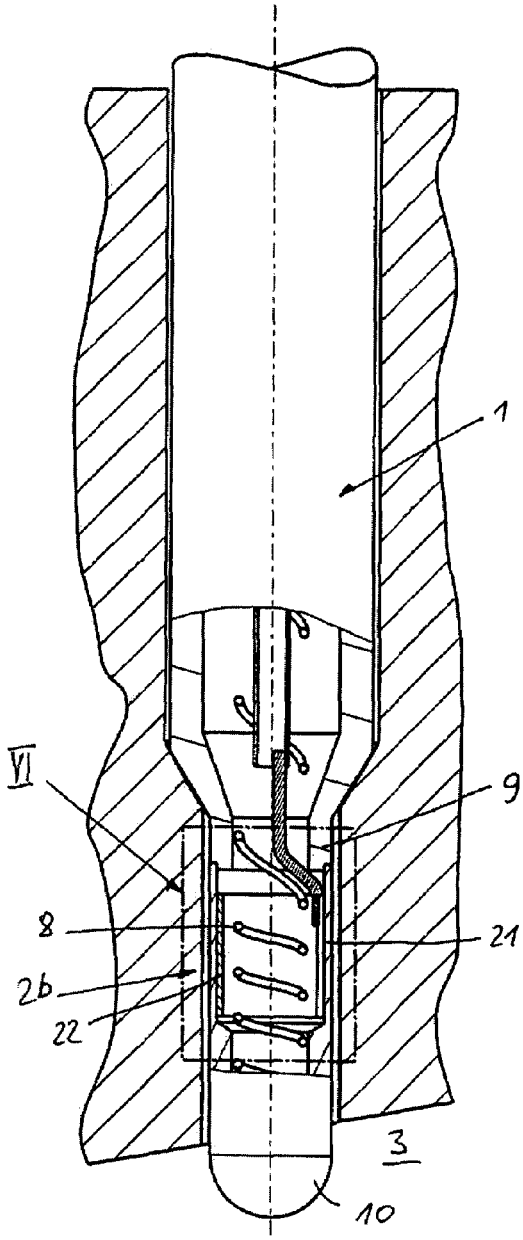
FIG. 5 a second variant of the invention in a sectional view.

In a second embodiment, as shown in FIGS. 5 and 6, a preferably cylindrical membrane 21 is provided in the section 9 of the glow plug 1 adjacent to the combustion chamber, on whose inner side a high-temperature resistant strain gauge 22 is applied. In this way a DMS-pressure sensor 2*b* is realized, with the glow coil 8 passing towards the tip of the glow plug 1 through the cylindrical interior space 23 bounded by the strain gauge 22. This will also permit very small diameters in a range <5 mm, while providing full functionality.

Figure 8:
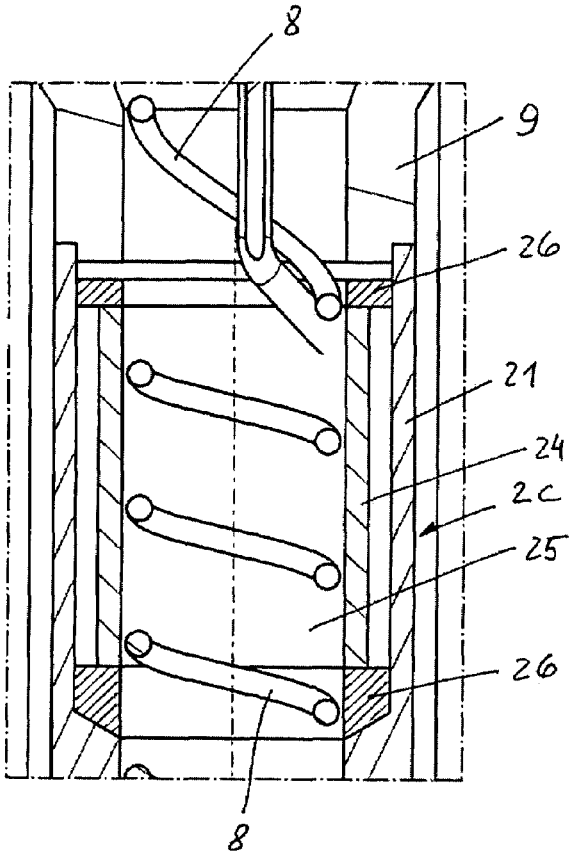
FIG. 8 an enlarged detail VIII of the variant of FIG. 7.
Figure 7:
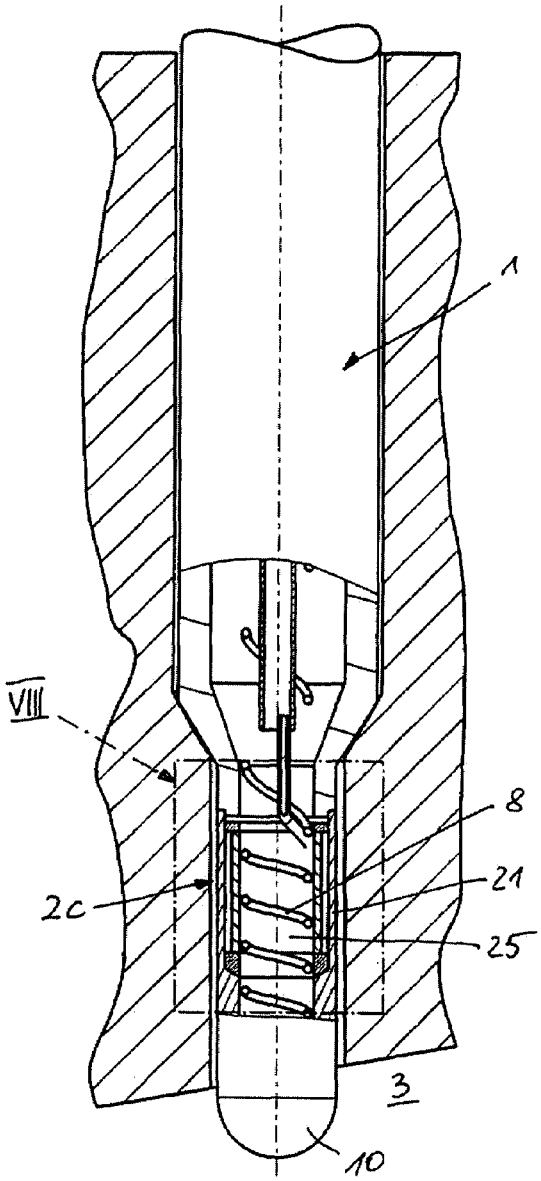
FIG. 7 a third variant of the glow plug according to the invention in a sectional view.

Finally in a third embodiment, as shown in FIGS. 7 and 8, a preferably cylindrical membrane 21 is provided in the section 9 of the glow plug 1 adjacent to the combustion chamber, which together with a distanced electrically conductive counter-surface 24 forms a capacitive pressure sensor 2*c*. In this variant the glow coil 8 may pass towards the tip of the glow plug 1 through the interior space 25 bounded by the counter-surface 24. The capacitive pressure sensor 2*c* has annular insulating elements 26 at both ends of the cylindrical membrane 21, which hold the cylindrical counter-surface 24 at a defined distance to the cylindrical membrane 21.

The invention claimed is:

1. Glow plug with integrated pressure sensor for measuring pressure in a combustion chamber of an internal combustion engine, the shell of the glow plug having a section of reduced diameter next to the combustion chamber, which houses a glow coil and ends in a tip protruding into the combustion chamber, and the pressure sensor being positioned without cooling in the section of the glow plug having a reduced diameter, wherein the pressure sensor is subjected to pressure in radial direction, and the glow coil of the glow plug or its electrical leads are guided towards the tip of the glow plug, either bypassing the pressure sensor or going through the pressure sensor.

2. Glow plug with integrated pressure sensor for measuring pressure in a combustion chamber of an internal combustion engine, the shell of the glow plug having a section of reduced diameter next to the combustion chamber, which houses a glow coil and ends in a tip protruding into the combustion chamber, and the pressure sensor being positioned without cooling in the section of the glow plug having a reduced diameter, and the electrical leads of the glow coil being guided towards the tip of the glow plug by going through the pressure sensor, wherein the pressure sensor is subjected to pressure in radial direction.

3. Glow plug according to claim 1, wherein a piezoelectric pressure sensor is placed between two opposing membranes in a radial through-bore of the section of the glow plug next to the combustion chamber, the glow coil or the electrical leads of said glow coil being guided towards the tip of the glow plug by bypassing the piezoelectric pressure sensor.

4. Glow plug according to claim 3, wherein the piezoelectric pressure sensor comprises a small measuring tube closed by a membrane at each end, which is inserted into the radial bore and whose longitudinal axis is at a right angle to the longitudinal axis of the glow plug and at least one piezoelectric measuring element is placed between the membranes.

5. Glow plug according to claim 4, wherein two or more plate or disk-shaped measuring elements are placed between the membranes, the smaller sides of the measuring elements contacting the membranes using the transversal piezoeffect.

6. Glow plug according to claim 5, wherein plane pick-up electrodes are provided between a pair of piezoelectric measuring elements, at least one signal lead exiting through an opening in the wall of the small measuring tube.

7. Glow plug according to claim 4, wherein the piezoelectric measuring element is made of high-temperature stable material.

8. Glow plug according to claim 7, wherein the piezoelectric measuring element is made of $GaPO_4$.

9. Glow plug according to claim 1, wherein in the section of the glow plug next to the combustion chamber a cylindrical membrane is provided, on whose inner side there is applied a high-temperature stable strain-gauge strip, the glow coil or the electrical leads of the glow coil being passed towards the tip of the glow plug through the cylindrical interior space bounded by the strain-gauge strip.

10. Glow plug according to claim 2, wherein in the section of the glow plug next to the combustion chamber a cylindrical membrane is provided, on whose inner side there is applied a high-temperature stable strain-gauge strip, the glow coil or the electrical leads of the glow coil being passed towards the tip of the glow plug through the cylindrical interior space bounded by the strain-gauge strip.

11. Glow plug according to claim 1, wherein in the section of the glow plug next to the combustion chamber a cylindrical membrane is provided, which together with a distanced electrically conductive counter-surface forms a capacitive pressure sensor, the glow coil or the electrical leads of the glow coil being passed towards the tip of the glow plug through the cylindrical interior space bounded by the counter-surface.

12. Glow plug according to claim 2, wherein in the section of the glow plug next to the combustion chamber a cylindrical membrane is provided, which together with a distanced electrically conductive counter-surface forms a capacitive pressure sensor, the glow coil or the electrical leads of the glow coil being passed towards the tip of the glow plug through the cylindrical interior space bounded by the counter-surface.

13. Glow plug according to claim 11, wherein the capacitive pressure sensor has annular insulating elements at both ends of the cylindrical membrane, which hold the cylindrical counter-surface at a defined distance to the cylindrical membrane.

* * * * *